US005968307A

United States Patent [19]

Siler et al.

[11] Patent Number: 5,968,307

[45] Date of Patent: Oct. 19, 1999

[54] APPARATUS FOR AFFIXING CARDS TO A MOVING WEB

[75] Inventors: Steven J. Siler, Cary, Ill.; Cornelius de Veer, Ijmuiden, Netherlands

[73] Assignee: Hurletron, Incorporated, Lincolnshire, Ill.

[21] Appl. No.: 09/054,293

[22] Filed: Apr. 2, 1998

[51] Int. Cl.[6] ..... B32B 31/00

[52] U.S. Cl. ..... 156/302; 156/361; 156/555; 156/560; 156/562

[58] Field of Search ..... 156/297, 299, 156/302, 361, 362, 538, 539, 555, 556, 559, 560, 562, 583.5

[56] References Cited

U.S. PATENT DOCUMENTS

| | | | |
|---|---|---|---|
| 3,143,342 | 8/1964 | Pine et al. | 270/52.5 |
| 3,178,170 | 4/1965 | Walck et al. | 270/58 |
| 3,493,156 | 2/1970 | Absler et al. | 225/100 |
| 4,351,517 | 9/1982 | Neal et al. | 270/52 |
| 5,079,901 | 1/1992 | Kotsiopoulos | 53/435 |
| 5,549,233 | 8/1996 | Clauser | 225/100 |
| 5,588,280 | 12/1996 | Kotsiopoulos | 53/435 |
| 5,658,638 | 8/1997 | Pottenger | 428/126 |
| 5,784,861 | 7/1998 | Kotsiopoulos | 53/435 |

FOREIGN PATENT DOCUMENTS

| | | | |
|---|---|---|---|
| 877824 | 8/1971 | Canada | 271/4 |

OTHER PUBLICATIONS

Hurletron Inc. Drawing No. 493886, Rev. 0, 1 sheet, Mar. 1998.

*Primary Examiner*—James Sells
*Attorney, Agent, or Firm*—Marshall, O'Toole, Gerstein, Murray & Borun

[57] ABSTRACT

An apparatus is disclosed for automatically affixing cards to a moving printed web which has a plurality of repeat lengths, each of the cards being automatically applied at the same relative location in each of a plurality of repeat lengths of the printed web. The apparatus includes a card feed device adapted to receive a web of cards having no registration holes formed therein and having a plurality of weakened links disposed between pairs of adjacent cards. The card feed device is adapted to cause the web of cards to pass through the card feed device so that there is substantially no slippage between the card feed device and the web of cards. The apparatus also includes a card handler operatively coupled to separate the web of cards into individual cards and cause them to be applied to the printed web and a controller adapted to control the card feed device so as to cause each of the cards to be applied to the printed web in a predetermined position in each of the repeat lengths of the printed web.

32 Claims, 6 Drawing Sheets

APPARATUS FOR AFFIXING CARDS TO A MOVING WEB

BACKGROUND OF THE INVENTION

The present invention is directed to an apparatus for automatically affixing pre-printed cards to a moving printed paper web in synchronism with the moving web so that each of the cards is affixed to the moving web at a predetermined position in a repeat length of the moving web.

An apparatus for affixing cards to a moving web of the type relating to the invention is disclosed in U.S. Pat. No. 4,351,517 to Neal, et al. That apparatus has a rotating feed roll 30 that receives a strip or web 12 of pre-printed cards and feeds the web of cards to an applicator drum 80 that periodically causes one of the pre-printed cards to be separated from the card web 12 and applied to a moving web 108 having a number of pre-printed pages.

Each card is affixed to the moving web 108, by adhesive, at the same predetermined position on each of the pages of the web 108. In order to accomplish that function, the position of the card web 12 with respect to the feed roll 30 must be precisely controlled at all times. To that end, the card web 12 is provided with a plurality of registration holes 34 along its length, as shown in FIG. 3 of the Neal, et al. patent, and the feed roll 30 is provided with a ring of registration pins 32. During operation, the card web 12 is passed over the feed roll 30 so that the registration pins 32 are positioned within the registration holes 34 in the card web 12 so that there is no slippage between the card web 12 and the feed roll 30.

The position of the card web 12 relative to the feed roll 30 has to be maintained fixed so that the cards are affixed in their proper places on the printed web 108. Any movement or slippage between the card web 12 and the feed roll 30 would cause cumulative error in the positions at which the cards are affixed to the printed web 108. For example, if the card web 12 were to slip relative to the feed roll 30 at a rate of 0.001 inch per card, and if the apparatus were run at the rate of 80,000 cards per hour as disclosed in the Neal, et al. patent, the cumulative positional error in the affixation of the cards to the printed web 108 would be more than one inch after only one minute of operation.

A prior art apparatus of the type described in the Neal et al. patent and marketed by Hurletron Incorporated, which was used to affix pre-printed cards having registration holes formed therein to a moving printed web using a card feed device with registration pins as described above, was provided with a controller to synchronize the movement of the web of pre-printed cards, which was moving at a first relatively low speed, to the movement of a printed web onto which the cards were to be affixed, which printed web was moving at a second, relatively fast speed. The controller was identical to the controller shown in FIG. 7 of this patent, and the controller included a computer program substantially identical to the one that is illustrated by the flowchart shown in FIGS. 8A–8C of this patent.

SUMMARY OF THE INVENTION

The present invention is directed to an apparatus for automatically affixing cards having printed subject matter thereon and having no registration holes formed therein to a moving printed web which has a plurality of repeat lengths, each of the cards being automatically applied to a successive one of the repeat lengths of the printed web at the same relative location in each of the repeat lengths. The apparatus includes a card feed device adapted to receive a web of cards having printed subject matter thereon, having no registration holes formed therein, and having a plurality of weakened links disposed between pairs of adjacent cards. The card feed device is adapted to cause the card web to pass through the card feed device so that there is substantially no slippage between the card feed device and the card web. The apparatus also includes a card handler operatively coupled to separate the card web into individual cards and cause the individual cards to be applied to the printed web and a controller operatively coupled to the card feed device and the card handler. The controller is adapted to control the card feed device and the card handler so as to cause each of the cards to be applied to the printed web in a predetermined position in each of the repeat lengths of the printed web.

The card feed device is preferably a pinless card feed device adapted to cause the card web to pass through the pinless card feed device so that the card web does not slip, relative to the pinless feed device, more than 0.001 or 0.0005 of an inch per card of the card web.

The card feed device may include a force applicator adapted to force the card web against a portion of the card feed device, such as a cylindrical feed wheel. The force applicator may comprise a belt disposed adjacent the portion of the card web and means for applying tension to the belt for forcing the belt against the portion of the card web. Alternatively, the force applicator may comprise at least one roller that makes contact with the portion of the card web.

The printed web may be moving at a first speed, the card web may be moving at a second speed slower than the first speed, and the controller may comprise control means for maintaining synchronism between the speed of the card web and the speed of the printed web and control means for maintaining a predetermined phase relationship between the card web and the printed web.

The invention is also directed to a method of automatically affixing pre-printed cards having no registration holes formed therein to a moving web having a plurality of repeat lengths wherein each of the cards is automatically applied to a successive one of the repeat lengths at the same relative location in each of the repeat lengths. The method includes the steps of: (a) providing a web of cards to a card feed device, the card web having printed subject matter thereon, having no registration holes formed therein, and having a plurality of weakened links disposed between pairs of adjacent cards, (b) passing the card web through the card feed device so that there is substantially no slippage between the card feed device and the card web, (c) separating the card web into individual cards, and (d) periodically affixing the individual cards to a printed web having a plurality of repeat lengths so that each of the cards is applied to the printed web at a predetermined position in each of the repeat lengths of the printed web.

Step (b) noted above may include the steps of passing the card web over a rotatable cylindrical feed wheel while the feed wheel is rotating at a rotational speed and, while the card web is passing over the feed wheel, applying pressure to force a portion of the card web against the feed wheel so that there is substantially no slippage between the card web and the feed wheel.

The features and advantages of the present invention will be apparent to those of ordinary skill in the art in view of the detailed description of the preferred embodiment, which is made with reference to the drawings, a brief description of which is provided below.

DETAILED DESCRIPTION OF THE PREFERRED EMBODIMENTS

Figure 1:
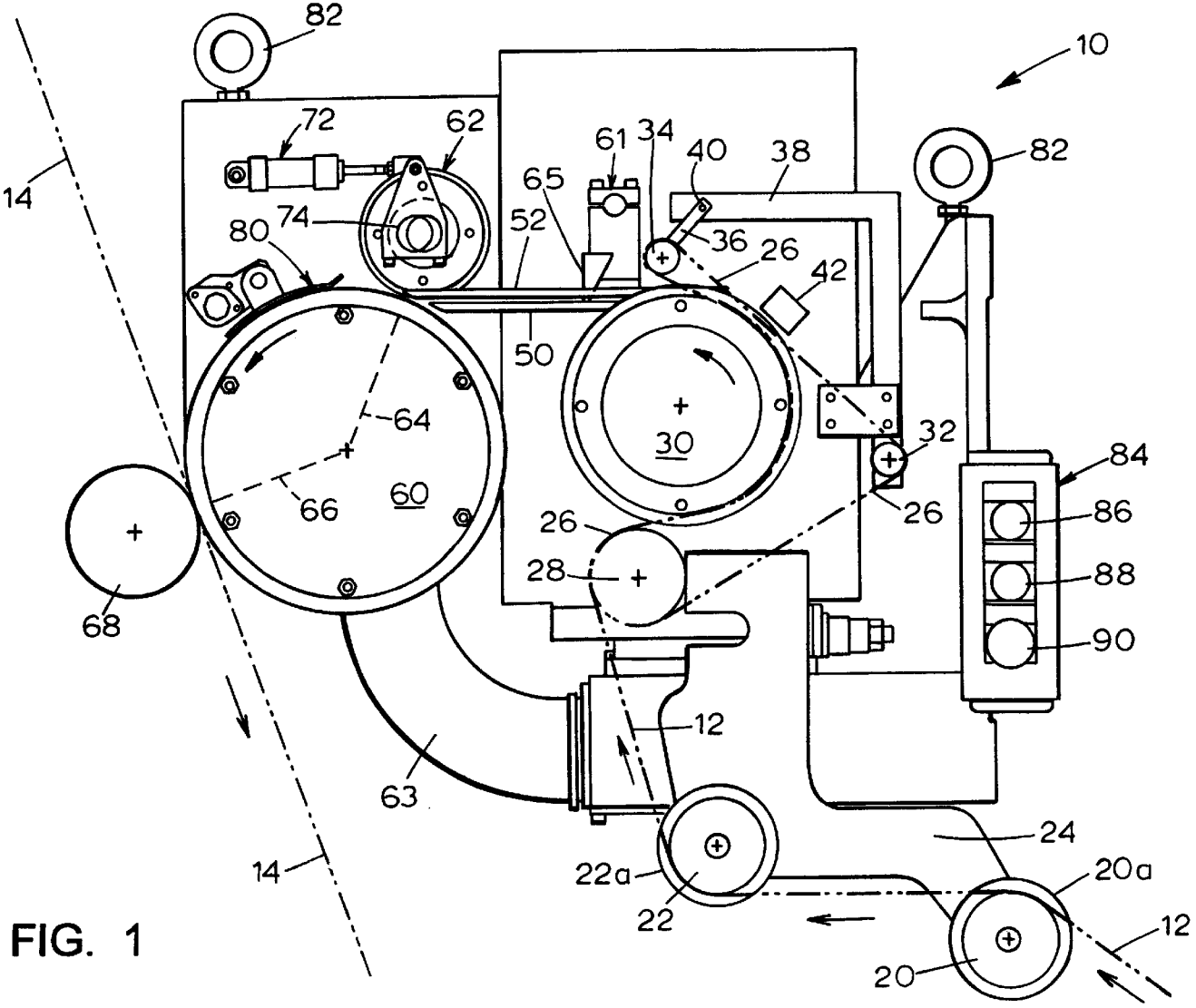
FIG. 1 illustrates the mechanical portions of a preferred embodiment of a card applicator for affixing pre-printed cards to a moving printed web.
Figure 3:
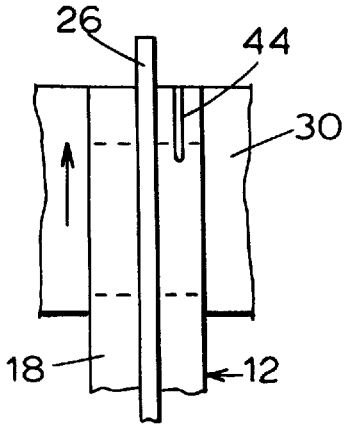
FIG. 3 is a side view of a portion of the feed wheel of the card applicator of FIG. 1 showing the relative position of a card web and a tension belt.

FIG. 1 illustrates the mechanical portions of a card applicator 10 for automatically affixed pre-printed paper cards to a moving printed web. The pre-printed cards, which may be coupons or mail reply postcards for example, are supplied to the card applicator 10 in the form of a card web 12 in which a weakened link, such as a perforation, is disposed between each pair of adjacent cards (as shown in FIG. 3). The card applicator 10 separates the card web 12 into individual cards, and then applies each card to a moving web 14 pre-printed to have an identical image printed in each of a number of adjacent repeat lengths, such as a repeat length corresponding to a page of an advertising flyer or magazine.

Figure 2:
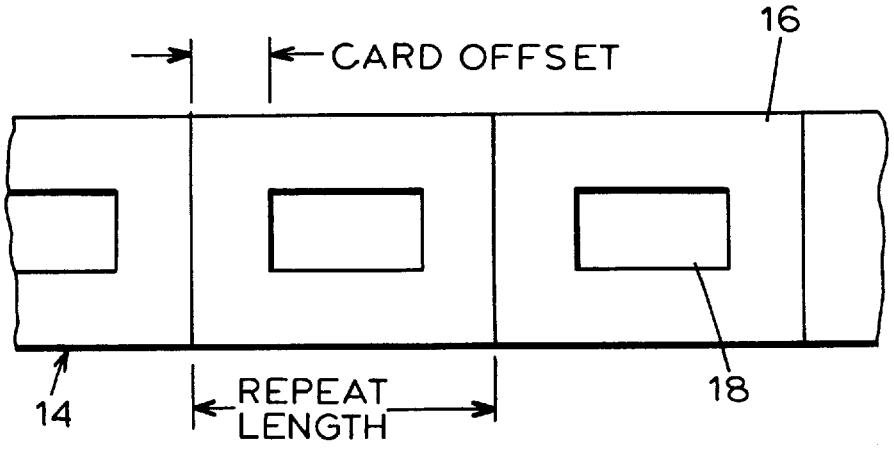
FIG. 2 illustrates a portion of a printed web having a number of pre-printed cards affixed thereto in accordance with the invention.

FIG. 2 illustrates a portion of the printed web 14 showing two full pages 16 each of which has a card 18 affixed to it, by adhesive for example, in a predetermined position on each page 16. Neither the cards 18 nor the card web 12 has any registration holes formed therein.

Referring to FIG. 1, the card web 12 is drawn into the card applicator 10 from a card web supply, such as a large box (not shown). The card web 12 may be disposed within the box in the manner disclosed in U.S. Pat. No. 5,658,638 to Pottenger entitled "Insert Card Packaging Method," for example, the disclosure of which is incorporated herein by reference. The card web 12 enters the card applicator 10, via a pair of rotatable idler rollers 20, 22 rotatably mounted to a support arm 24, and moves in the direction of the arrows. Each of the idler rollers 20, 22 has a pair of larger-diameter collars 20*a*, 22*a* between which the card web 12 passes. The collars 20*a*, 22*a* of each roller 20, 22 are spaced apart by a distance generally corresponding to the width of the card web 12 so as to maintain the card web 12 in a predetermined lateral position.

After passing over the idler rollers 20, 22, the card web 12 passes over a tension belt 26 supported at one end by a support roller 28, and then the card web 12 passes between the tension belt 26 and a rotatable feed wheel 30. The feed wheel 30, which may have an outer surface composed of smooth aluminum, is rotatably driven in a manner described below. The belt 26 is not driven, but moves at the same speed as the card web 12 due to the tension of the belt 26 and the friction between the card web 12 and the tension belt 26.

The tension belt 26 is further supported by a roller 32 rotatably mounted at a fixed point and a roller 34 rotatably mounted to a pivot arm 36 having an end pivotally connected to a support structure 38 at a pivot point 40. The pivot arm 36 is adapted to hold the belt 26 in a tightened state so that resulting tension of the belt 26 forces the card web 12 against the feed wheel 30 so that there is no slippage between the card web 12 relative to the feed wheel 30, as described in more detail below.

The pivot arm 36 may be spring-biased in a clockwise direction to provide the belt tension, or alternatively the end of the pivot arm 36 could be connected to the support structure 38, by a nut and bolt assembly for example, so that the position of the pivot arm 36 is fixed and non-movable. In the latter case, the pivot arm 36 could be forced in a clockwise direction to provide the desired belt tension, and with the pivot arm 36 in that position, the nut of the nut and bolt assembly could then be tightened so that the pivot arm 36 maintains its position and the desired belt tension.

An adhesive applicator shown schematically at 42 is disposed adjacent the card web 12 at a point at the upper right hand portion of the feed wheel 30 as shown in FIG. 1. As shown in FIG. 3, the adhesive applicator 42 applies a relatively thin, continuous bead of glue 44 along one side of the card web 12. The tension belt 26 is narrower than the card web 12 so that the glue bead 44 can be applied without coming into contact with the tension belt 26, which overlaps the card web 12.

Referring to FIG. 1, after being in contact with the feed wheel 30 for approximately half the circumference of the feed wheel 30, the card web 12 is guided by a plurality of lower guide members 50 and a plurality of upper guide members 52 to a card handler, which may be in the form of a rotatable vacuum drum 60 and a rotatable nip wheel 62. The guide members 50, 52 have a relatively narrow width and are spaced across the width of the card web 12 so as to avoid the glue bead 44 previously deposited by the adhesive applicator 42. The upper guide members 52 are supported by a mounting bracket 61.

In order to affix each card 18 to the same relative location on each page 16 of the printed web 14, the speed at which the printed web 14 passes through the card applicator 10 must be greater than the speed at which the card web 12 passes through the card applicator 10, since the size of a card 18 is smaller than the size of a page 16 to which the card 18 is affixed, as shown in FIG. 2. The vacuum drum 60 is driven to rotate so that the speed of the outer cylindrical surface of the vacuum drum 60 is the same as the speed of the printed web 14. Thus, the surface speed of the outer surface of the vacuum drum 60 and that of the nip wheel 62, which is in contact with the vacuum drum 60, is greater than the speed at which the card web 12 is fed by the feed wheel 30.

Consequently, as the card web 12 comes into contact with the intersection of the nip wheel 62 and the vacuum drum 60, the card 18 at the leading portion of the card web 12 is gripped tightly between the vacuum drum 60 and the nip wheel 62, which has a rubber surface, and is then accelerated to cause the leading card 18 to be separated from the remaining portion of the card web 12 at a separation point corresponding to the weakened link provided between the leading card 18 and the remainder of the card web 12. The nip wheel 62 has a relatively narrow width, e.g. about one inch, so that the nip wheel 62 does not come in contact with the glue bead 44 on the card web 12.

A burst deflector 65 is positioned between the feed wheel 30 and the nip roll 62. The burst deflector 65, which may be provided in the form of a relatively thin, vertically disposed, triangularly shaped plate, has a rounded bottom that exerts a slight downward force on the card web 12 at a contact point. The contact point preferably coincides with the perforation or weakened link at the trailing edge of the leading card 18 of the card web 12 when the leading edge of that card 18 is first gripped between the nip wheel 62 and the vacuum drum 60. The downward force applied by the burst deflector 65 to the weakened link as the nip wheel 62 and vacuum drum 60 apply the separation force to the leading card 18 concentrates the separation force at the weakened link and facilitates separation of the leading card 18. In the case where two lower guides 50 are used, each lower guide 50 being disposed beneath a respective longitudinal side of the card web 12, the burst deflector 65 may cause the middle portion of the card web 12 at the contact point to be deflected slightly downwardly.

After the leading card 18 is separated from the rest of the card web 12, that card 18 is held in place on the vacuum drum 60 by a reduced or suction pressure. The vacuum drum 60 has a hollow interior portion in which a reduced or suction pressure is provided and an outer cylindrical surface with a plurality of holes formed therein so that the suction pressure is communicated to the surface of the vacuum drum 60. The suction pressure in the interior of the vacuum drum 60 is provided via a vacuum conduit or duct 63 that is pneumatically coupled to a vacuum pump (not shown).

The suction pressure may be provided only to an angular portion of the surface of the vacuum drum 60, such as the portion between the dotted line 64 and the dotted line 66, so that the card 18 is held in place until it makes contact with the printed web 14 at the intersection of the vacuum drum 60 with a pressure roller 68. The pressure roller 68 presses the printed web 14 against the card 18 so that the adhesive bead on the card 18 holds the card 18 to the printed web 14.

The nip wheel 62 may be provided with an adjustment mechanism in the form of a piston/cylinder assembly 72 eccentrically coupled to a movable axle 74 that rotatably supports the nip wheel 62, so that the nip wheel 62 can be moved between an operative position in which it makes contact with the vacuum drum 60 and a non-operative position in which it is spaced from the vacuum drum 60.

A card guide 80 may be mounted adjacent the vacuum drum 60 between the nip wheel 62 and the pressure roller 68. The purpose of the card guide 80 is to prevent, in the event of loss of suction pressure in the vacuum drum 60, errant cards 18 from hitting the printed web 14 at such an angle so as to break the web 14. The card applicator 10 may also include a number of lifting hooks 82 for installation purposes and a switch box 84 having various operator control buttons such as a start/stop button 86, a button 88 for starting and stopping the adhesive applicator 42, and an emergency stop button 90.

The tension belt 26 shown in FIGS. 1 and 3, which may be a rubber belt with internal fiber strands about 20 millimeters wide and two millimeters thick, is adapted to force the card web 12 against the feed wheel 30 so that the combination of the coefficient of friction between the cylindrical surface of the feed wheel 30 and the card web 12 and the force applied by the tension belt 26 are sufficient so that there is substantially no slippage between the card web 12 and the feed wheel 30 as the feed wheel 30 is rotatably driven. If there is any slippage between the card web 12 and the feed wheel 30, such slippage is less than 0.005 of an inch, and preferably less than 0.001 of an inch per card or less than 0.0005 of an inch per card.

Figure 4:
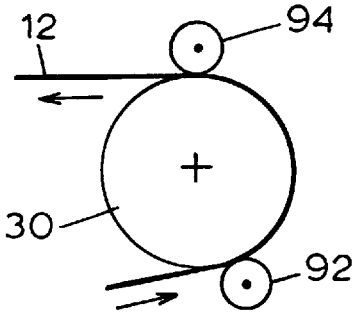
FIG. 4 illustrates a first alternative embodiment of a feed device for feeding a web of pre-printed cards.

Instead of using the particular card feed device described above, other card feed devices could be utilized. FIG. 4 illustrates a first alternative embodiment in which a pair of pressure rollers 92, 94 are used instead of the tension belt 26. One of the pressure rollers 92 is positioned adjacent the card web 12 at a point where the web 12 first makes contact with the feed wheel 30, and the other pressure roller 94 is positioned adjacent the point where the web 12 leaves the feed wheel 30. The pressure rollers 92, 94 may be provided with rubber or other compressible coatings.

Figure 5:
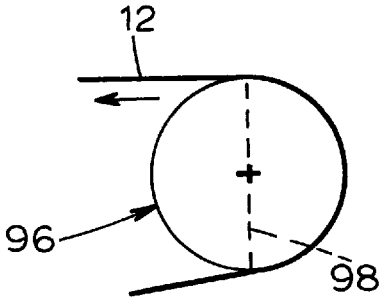
FIG. 5 illustrates a second alternative embodiment of a feed device for feeding a web of pre-printed cards.

In a second alternative embodiment shown in FIG. 5, the feed wheel 30 is replaced by a vacuum drum 96 which applies a suction pressure to the card web 12 in contact with the vacuum drum 96. The suction pressure may be applied only to a portion of the surface of the drum 96, such as the portion to the right of dotted line 98. The combination of the coefficient of friction between the outer cylindrical surface of the vacuum drum 96 and the card web 12 and the vacuum force holding the card web 12 to the vacuum drum 96 should be sufficient to prevent any significant slippage between the card web 12 and the vacuum drum 96. The vacuum force should also be sufficient to prevent slippage when the leading card is removed from the card web 12, or alternative structures should be used to accomplish that result.

Figure 6:
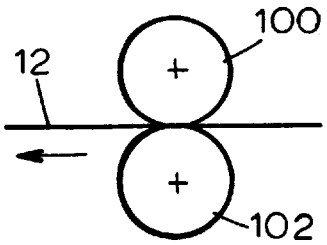
FIG. 6 illustrates a third alternative embodiment of a feed device for feeding a web of pre-printed cards.

In a third alternative embodiment shown in FIG. 6, the feed wheel 30 and the tension belt 26 are replaced by a pair of precision pressure rollers 100, 102 which feed the card web 12 in a horizontal direction as shown by the arrow in FIG. 6. One or both of the rollers 100, 102 could be provided with a rubber or compressible surface to prevent slippage of the card web 12 relative to the precision rollers 100, 102.

Other details regarding the structure of the mechanical portion of the card applicator 10 described above are disclosed in U.S. Pat. No. 4,351,517 to Neal, et al., the disclosure of which is incorporated herein by reference. Although a particular mechanical structure for the card applicator 10 is described above, numerous modifications could be made to that structure without departing from the invention.

Figure 7:
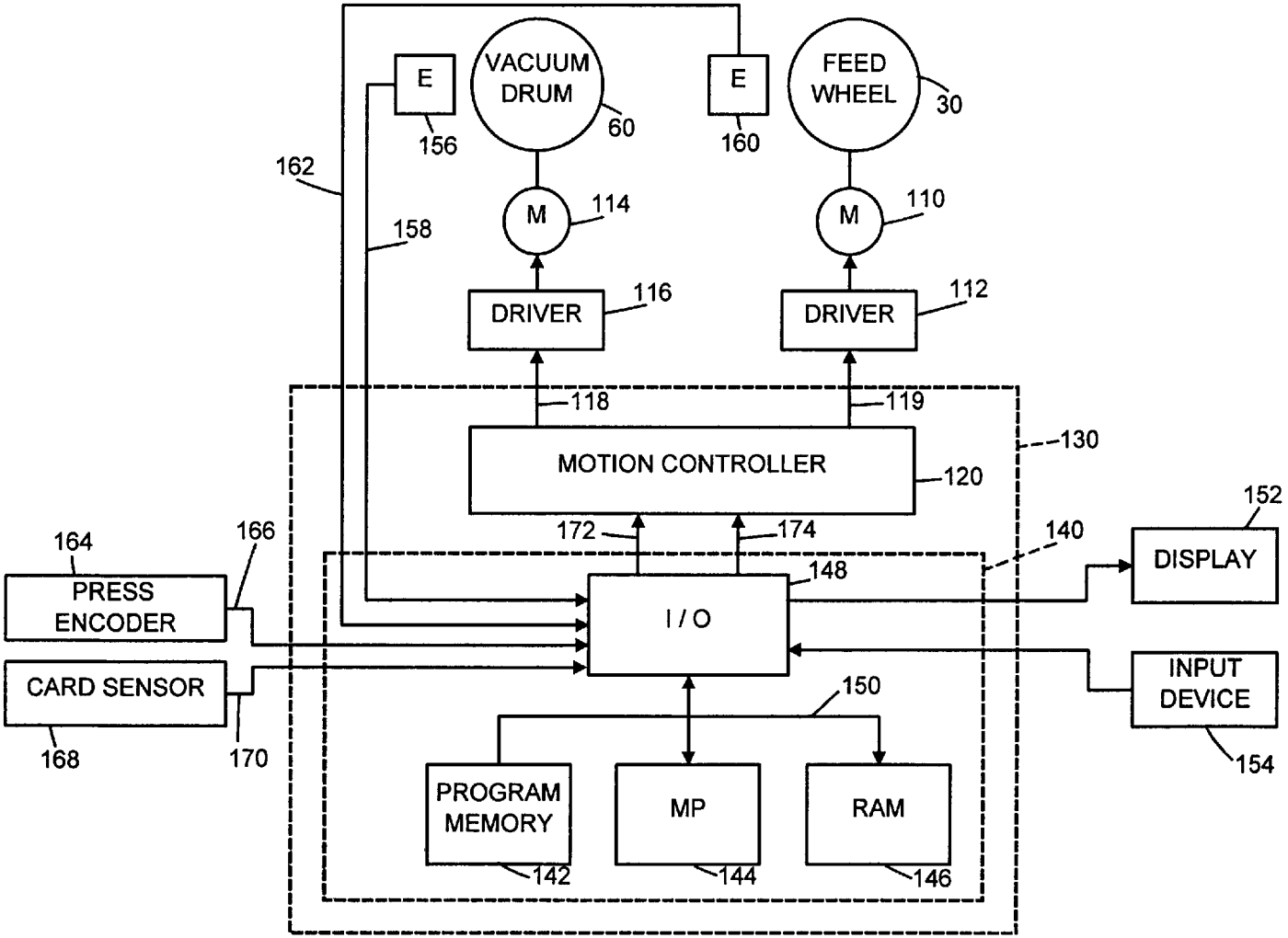
FIG. 7 is a block diagram illustrating the electronics portion of the card applicator shown in FIG. 1.

FIG. 7 is a block diagram of the control portion of the card applicator 10 which controls the rotational speed of the feed wheel 30 and the vacuum drum 60. Referring to FIG. 7, the feed wheel 30 is rotatably driven by a motor 110 in response to drive signals generated by a conventional drive circuit 112. Similarly, the vacuum drum 60 is rotatably driven by a motor 114 in response to drive signals generated by a drive circuit 116. The drive signals output by the two drive circuits 112, 116 are generated in response to control signals provided to the drive circuits via a number of control lines 118, 119 generated by a motion controller 120, which may be a conventional motion controller commercially available from MEI Incorporated.

The motion controller 120 forms part of an overall controller 130, which also includes a main controller 140. The main controller 140 may be a conventional controller, such as a personal computer, having a program memory 142, such as a read-only memory (ROM), a microprocessor (MP) 144, a random-access memory (RAM) 146 and an input-output (I/O) circuit 148, all of which are interconnected via an address/data bus 150. The main controller 140 may be connected to a display device 152, such as a CRT, and to an input device 154, such as a keyboard.

The control portion of the card applicator 10 has a sensor 156, such as a shaft encoder, associated with the vacuum drum 60 that generates a signal indicative of the angular position or rotation of the vacuum drum 60. For example, the sensor 156 may generate a predetermined number of pulses, such as 10,000, for each complete revolution of the vacuum drum 60, or alternatively may generate a predetermined number of pulses, such as 5,000, for a predetermined rotational distance of the vacuum drum, such as one foot. The signal generated by the sensor 156 is transmitted to the motion controller 120 and to the I/O circuit 148 via a signal line 158. The card applicator 10 includes a sensor 160, such as a shaft encoder, associated with the feed wheel 30 that generates a signal indicative of the angular position or rotation of the feed wheel 30 and transmits the signal to the motion controller 120 and to the I/O circuit via a signal line 162.

The card applicator 10 has a sensor in the form of a press encoder 164 that is operatively coupled to a portion of the printing press (not shown) that prints the printed web 14. The press encoder 164 generates a signal indicative of the speed and position of the printed web 14 and transmits that signal to the I/O circuit 148 via a signal line 166.

The card applicator 10 also has a card sensor 168 that is positioned at a fixed location, between the feed wheel 30 and the vacuum drum 60, at which the lead card 18 in the card web 12 has been separated from the card web 12. The card sensor 168 generates a signal upon detecting an edge of the separated card 18, such as the trailing edge of the card 18, and transmits that edge-detect signal to the I/O circuit 148 via a line 170.

In response to the signals provided by the sensors 156, 160, 164, 168, the main controller 140 generates a pair of control signals on a pair of lines 172, 174 to the motion controller 120 to adjust the rotational speed of the feed wheel 30 and the vacuum drum 60.

Figure 8A:
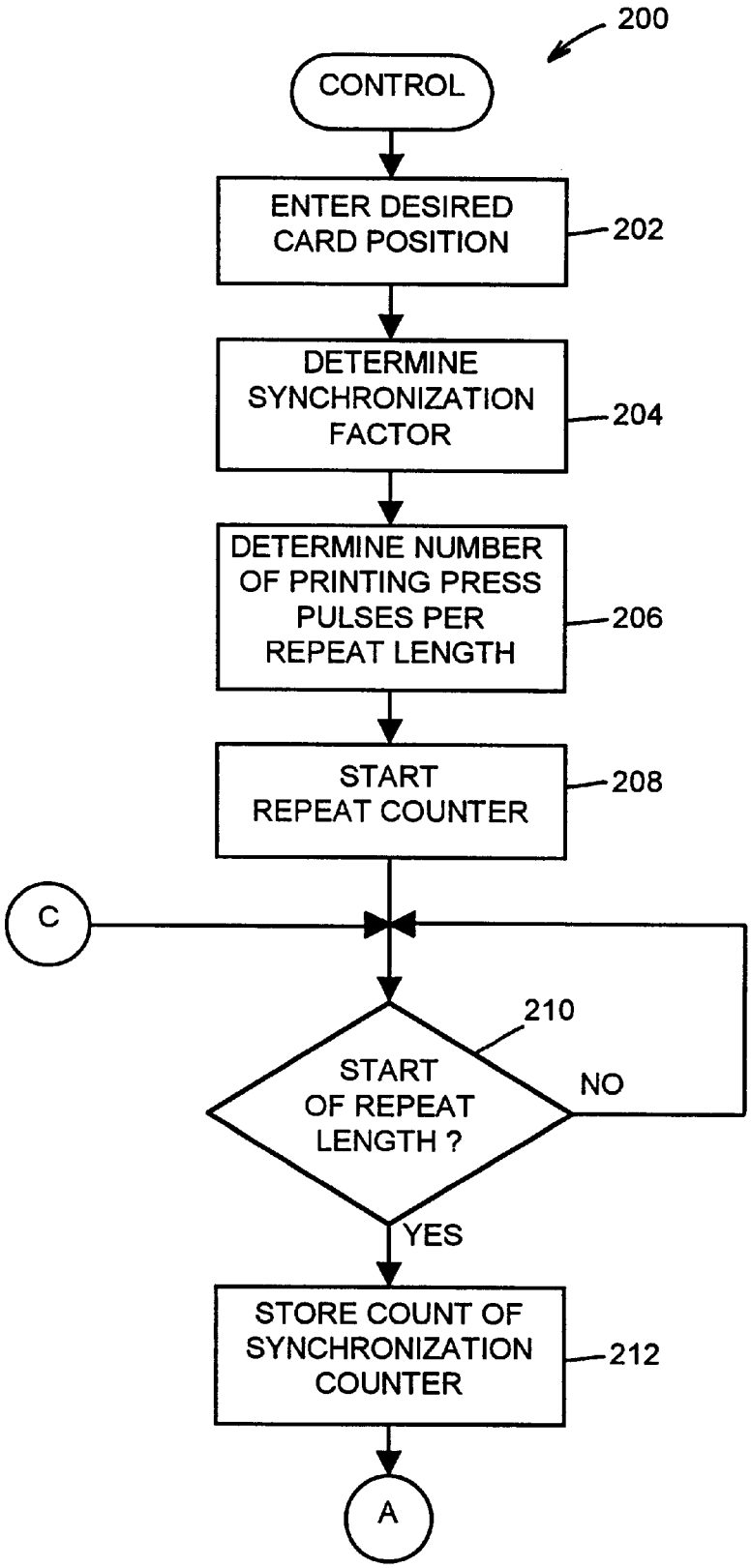
FIGS. 8A–8C are a flowchart of a computer program incorporated in the controller shown in FIG. 7 for controlling the operation of the card applicator.
Figure 8B:
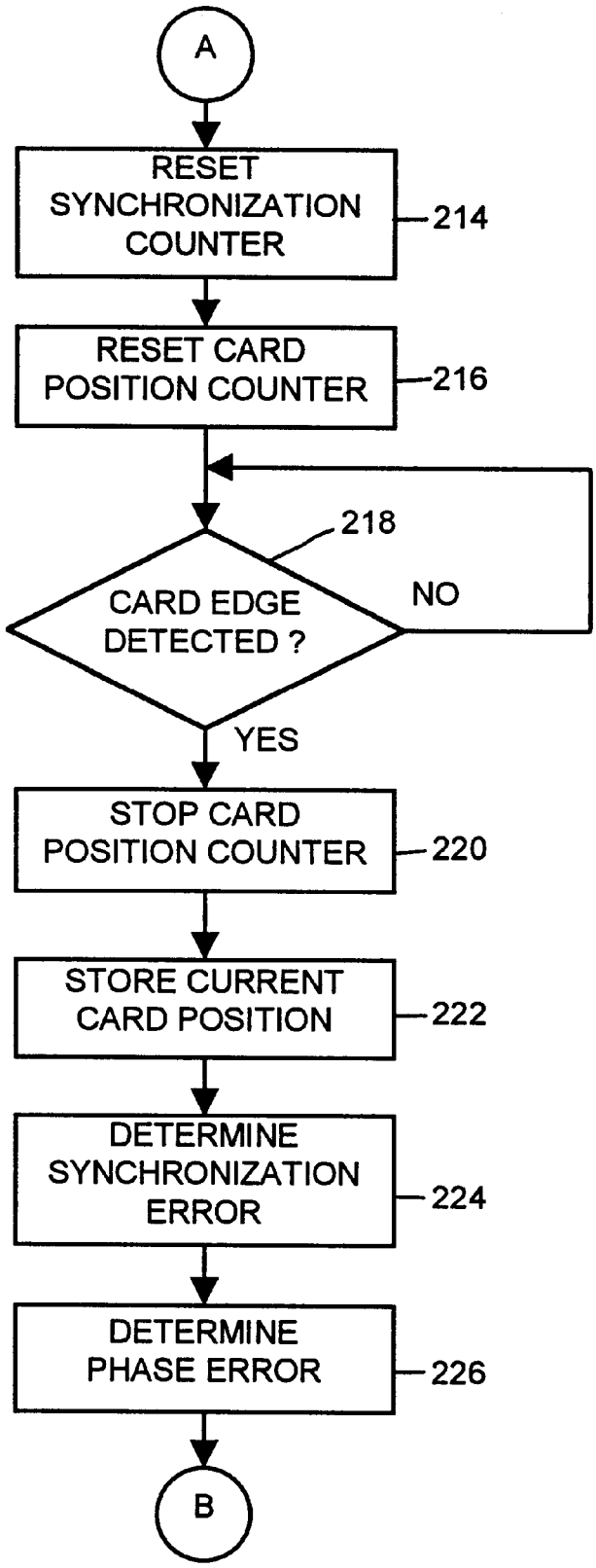
Figure 8C:
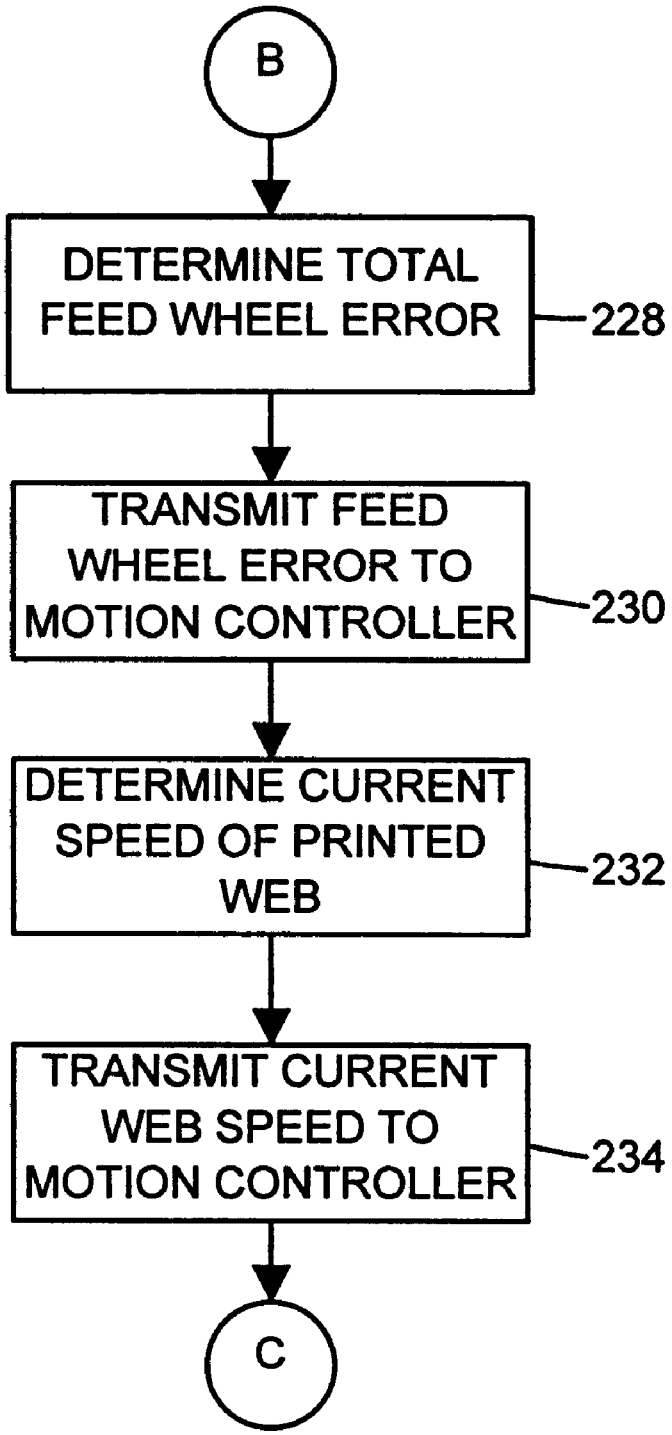

FIGS. 8A through 8C illustrate a flowchart of a computer program control routine 200 that is performed by the main controller 140 to control the rotational speed of the feed wheel 30 and the vacuum drum 60 during operation of the card applicator 10. The control routine 200 performs the following basic functions: 1) it causes the vacuum drum 60 to be rotatably driven so that the speed at which the outer surface of the vacuum drum 60 travels is substantially the same as the speed of the printed web 14; 2) it causes the rotational speed of the feed wheel 30 to be synchronized to the speed of the printed web 14 so that exactly one card 18 is fed for each repeat length or page 16 of the printed web; and 3) it causes the rotational speed of the feed wheel 30 to be phase-controlled so that each card 18 is placed at the same predetermined position in each repeat length or page 16 of the printed web 14.

Referring to FIG. 8A, the control routine 200 begins operation at step 202 where the operator enters, via the input device 154, the relative position on the page 16 at which it is desired to place the cards 18. For example, this position could correspond to the card offset, in inches for example, shown in FIG. 2.

The offset position entered by the operator, if entered in units of distance, may be translated into other units, such as the number of pulses that would be generated by the press encoder 164 during movement of the printed web 14 for a distance corresponding to the offset position. For example, if the operator entered an offset position of three inches, and if the press encoder 164 generates 10,000 pulses per foot of travel of the printed web 14, the translated offset position would be 2,500 pulses (10,000 pulses per foot multiplied by 0.25 feet).

At step 204, a synchronization factor used to synchronize the rotation of the feed wheel 30 with the speed of the printed web 14 is determined. For example, if the length of a card 18 to be applied to the printed web 14 is six inches, and if the repeat length (or length of a page 16) of the printed web 18 is twelve inches, for every twelve inches of movement of the printed web 14, the outer surface of the feed wheel 30 must travel six inches to remain in synchronism with the printed web 14.

The synchronization factor determined at step 204 could be, for example, the number of pulses that should be generated by the feed wheel sensor 160 for each repeat length of the printed web 14. Thus, in the above example where the length of the cards 18 is six inches, if the feed wheel sensor 160 generates 10,000 pulses per foot, the synchronization factor in that case would be 10,000 pulses per foot of travel multiplied by 0.5 feet (six inch card length) to come up with a synchronization factor of 5,000 pulses per repeat length.

At step 206, the number of pulses that would be generated by the press encoder 164 coupled to the printing press that prints the printed web 14 for each repeat length of the printed web is determined based on the repeat length. For example, if the press encoder 164 generates 10,000 pulses per lineal foot of the printed web 14 and if the repeat length (see FIG. 2) was nine inches, step 206 would determine the number of printing press pulses per repeat length by multiplying 10,000 pulses per foot by 0.75 feet/repeat length to arrive at a number of 7,500 press pulses per repeat length.

At step 208, a repeat counter (not shown) is started. The repeat counter, which may be a conventional modulo counter implemented in software for example, continuously counts the number of pulses generated by the press encoder 164.

At step 210, the routine waits for the start of a repeat length. A repeat length (see FIG. 2) is considered to start when the number of press encoder pulses counted by the repeat counter reaches the predetermined number (determined at step 206) which corresponds to exactly one repeat length. Upon the start of repeat, the routine branches to step 212.

Upon each start of repeat, which corresponds to the travel of a single repeat length or page 16, steps 212 through 234 are performed to generate a pair of control signals that are sent to the motion controller via the lines 172, 174, which cause the motion controller 120 to adjust the rotational speed of the feed wheel 30 and the vacuum drum 60.

The card applicator 10 has a synchronization counter that is used to synchronize the rotation of the feed wheel 30 with the speed of the printed web 14. For example, the synchronization counter, which may be a counter implemented in software for example, may continuously count the number of pulses generated by the feed wheel sensor 160 to keep track of the rotational movement of the feed wheel 30. Since step 212 is performed once for each repeat length of the printed web 14, the count stored at step 212 represents the distance (measured in feed wheel pulses) through which the feed wheel 30 rotated during the last repeat length. At step 214, the synchronization counter is reset to zero, after which it continues to count the pulses generated by the feed wheel sensor 160.

The card applicator 10 includes a card position counter which is used to adjust the phase or position at which cards 18 are placed on the printed web 14. The card position counter may, for example, continuously count the number of pulses generated by the press encoder 164. At step 216, the card position counter is reset to zero since it is the start of a new repeat length as determined at step 210.

At step 218, the routine waits until the card sensor 168 detects the leading edge of the next card 18, at which time the program branches to step 220 where the card position counter is stopped, and then to step 222 where the current card offset position is stored by storing the count of the card position counter.

At step 224, the synchronization error between the rotation of the feed wheel 30 and the movement of the printed web 14 is determined, based upon the synchronization factor determined at step 204 and the synchronization count stored at step 212. In the example noted above in connection with step 204, the synchronization factor was 5,000 pulses of the feed wheel sensor 160 per repeat length. Using this example, if the synchronization count stored at step 212 corresponded to only 4,500 pulses (generated by the feed wheel sensor 160 during the repeat length), the synchronization error would be determined at step 224 to be 500 pulses (the difference between the synchronization factor and the synchronization count), which would mean that the rotational speed of the feed wheel 30 was too slow (by 500 pulses or about 10%).

At step 226, the phase or offset position error is determined based on the desired offset position entered by the operator at step 202 and the count of the card position counter as determined at step 220. For example, if the desired offset position of the cards 18 is three inches, corresponding to 2,500 pulses of the press encoder 164, and if the measured offset position of the card position sensor determined at step 222 corresponded to 2,000 pulses of the press encoder 164, the phase error determined at step 226 would correspond to the difference between the desired position and the measured position, or 500 pulses in this case (the card 18 would in this case be placed too close to the leading or left-hand edge of the page 16 by about 20% of the desired offset distance).

At step 228, the total error in the position of the feed wheel 30 is determined by adding the synchronization error determined at step 224 to the phase error determined at step 226, taking into account the sign of both errors (i.e. the feed wheel 30 could be too advanced in one case and could lag in the other). At step 230, the total error determined at step 228 is transmitted to the motion controller 120 via the control line 174, and the motion controller 120 causes the position and/or rotational speed of the feed wheel 30 to be adjusted via the control line 119.

Steps 232 and 234 are performed to control the vacuum drum 60 to cause it to rotate at the same speed at which the printed web 14 is moving. At step 232, the current speed of the printed web 14 is determined based upon the rate at which pulses are being received by the press encoder 164, for example. At step 234, the current speed of the printed web 14 is transmitted to the motion controller 120 via the control line 172, and the motion controller 120 causes the speed of the vacuum drum 60 to be adjusted (if necessary) to match the speed of the printed web 14, via the control line 118. After the completion of step 234, the program branches back to step 210 shown in FIG. 8A, where the program waits for the start of the next repeat length.

Although a specific manner of synchronizing the feed wheel 30 to the speed of the printed web 14 and of controlling the offset position at which cards 18 are affixed to the printed web 14, other methods of control could be utilized.

Numerous modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A method of automatically affixing cards having printed subject matter thereon and having no registration holes formed therein to a printed web moving at a first speed, said printed web comprising a plurality of repeat lengths, each of said cards being automatically applied to a successive one of said repeat lengths at the same relative location in each of said repeat lengths, said method comprising the steps of:

(a) providing a web of cards to a card feed device, said web of cards having printed subject matter thereon and having no registration holes formed therein, said web of cards having a plurality of weakened links formed therein, each of said weakened links being disposed between a pair of adjacent cards;

(b) passing said web of cards through said card feed device at a second speed slower than said first speed so that there is substantially no slippage between said card feed device and said web of cards;

(c) separating said web of cards into individual cards; and (d) periodically affixing said individual cards to said printed web so that each of said cards is applied to said printed web at a predetermined position in each of said repeat lengths of said printed web.

2. A method as defined in claim 1 wherein said step (b) comprises the steps of:

(b1) passing said web of cards over a rotatable cylindrical feed wheel while said feed wheel is rotating at a rotational speed; and (b2) while said web of cards is passing over said feed wheel, applying pressure to force a portion of said web of cards against said feed wheel so that there is substantially no slippage between said web of cards and said feed wheel.

3. A method as defined in claim 1 wherein said step (b) comprises the step of passing said web of cards through said card feed device so that said web of cards does not slip, relative to said card feed device, more than 0.001 of an inch per card of said web of cards.

4. A method as defined in claim 1 wherein said step (b) comprises the step of passing said web of cards through said card feed device so that said web of cards does not slip, relative to said card feed device, more than 0.0005 of an inch per card of said web of cards.

5. A method as defined in claim 1 additionally comprising the steps of:

(e) maintaining synchronism between said second speed of said web of cards and said first speed of said printed web; and (f) maintaining a predetermined phase relationship between said web of cards and said printed web.

6. An apparatus for automatically affixing cards having printed subject matter thereon and having no registration holes formed therein to a printed web moving at a first speed, said printed web having a plurality of repeat lengths, each of said cards being automatically applied to a successive one of said repeat lengths of said printed web at the same relative location in each of said repeat lengths, said apparatus comprising:

a rotatable feed wheel adapted to receive a web of cards having printed subject matter thereon and having no registration holes formed therein, said web of cards having a plurality of weakened links formed therein, each of said weakened links being disposed between a pair of adjacent cards, said feed wheel having a cylindrical surface and said web of cards making substantially flush contact with said cylindrical surface of said feed wheel, said cylindrical surface having a coefficient of friction relative to said web of cards;

a motor operatively coupled to said feed wheel for causing said feed wheel to be rotatably driven at a rotational speed;

a force applicator adapted to apply a force against a portion of said web of cards when said portion of said web of cards is in flush contact with said cylindrical surface of said feed wheel, said coefficient of friction and said force applied by said force applicator being sufficient to cause said web of cards to have substantially the same speed as said feed wheel so that there is substantially no slippage between said cylindrical surface of said feed wheel and said web of cards when said feed wheel is driven by said motor at said rotational speed;

a card handler operatively coupled to separate said web of cards into individual cards after said web of cards has been fed by said feed wheel and cause said individual cards to be applied to said printed web; and a controller operatively coupled to said motor, said controller being adapted to cause said motor to adjust said rotational speed of said feed wheel so as to cause said web of cards to move at a second speed slower than said first speed and to cause said card handler to apply each of said cards to a predetermined position in each of said repeat lengths of said printed web, said controller comprising:

control means for maintaining synchronism between said second speed of said web of cards and said first speed of said printed web; and control means for maintaining a predetermined phase relationship between said web of cards and said printed web.

7. An apparatus as defined in claim 6 wherein said feed wheel has a substantially smooth metal surface.

8. An apparatus as defined in claim 6 wherein said card handler comprises a vacuum drum having an interior portion in which a suction pressure is provided and a cylindrical outer portion in which a plurality of holes are formed.

9. An apparatus as defined in claim 6 wherein said force applicator comprises a belt disposed adjacent said portion of said web of cards.

10. An apparatus as defined in claim 6 wherein said force applicator comprises a belt disposed adjacent said portion of said web of cards and means for applying tension to said belt for forcing said belt against said portion of said web of cards.

11. An apparatus as defined in claim 6 wherein said force applicator comprises at least one roller that makes contact with said portion of said web of cards.

12. An apparatus as defined in claim 6 wherein said controller comprises a motion controller and a main controller coupled to said motion controller.

13. An apparatus as defined in claim 6 additionally comprising a sensor operatively coupled to generate a signal indicative of said rotational speed of said feed wheel.

14. An apparatus for automatically affixing cards having printed subject matter thereon and having no registration holes formed therein to a printed web moving at a first speed, said printed web having a plurality of repeat lengths, each of said cards being automatically applied to a successive one of said repeat lengths of said printed web at the same relative location in each of said repeat lengths, said apparatus comprising:

a card feed device adapted to receive a web of cards having printed subject matter thereon and having no registration holes formed therein, said web of cards having a plurality of weakened links formed therein, each of said weakened links being disposed between a pair of adjacent cards, said card feed device being adapted to cause said web of cards to pass through said card feed device so that there is substantially no slippage between said card feed device and said web of cards;

a card handler operatively coupled to separate said web of cards into individual cards and cause said individual cards to be applied to said printed web; and a controller operatively coupled to said card feed device, said controller being adapted to control said card feed device so as to cause said web of cards to move at a second speed slower than said first speed and to cause each of said cards to be applied to said printed web in a predetermined position in each of said repeat lengths of said printed web, said controller being adapted to maintain synchronism between said second speed of said web of cards and said first speed of said printed web, and said controller being adapted to maintain a predetermined phase relationship between said web of cards and said printed web.

15. An apparatus as defined in claim 14 wherein said card feed device comprises a cylindrical feed wheel.

16. An apparatus as defined in claim 14 wherein said card handler comprises a vacuum drum having an interior portion in which a suction pressure is provided and a cylindrical outer portion in which a plurality of holes are formed.

17. An apparatus as defined in claim 14 wherein said card feed device comprises a force applicator adapted to force a portion of said web of cards against a portion of said card feed device.

18. An apparatus as defined in claim 17 wherein said force applicator comprises a belt disposed adjacent said portion of said web of cards and means for applying tension to said belt for forcing said belt against said portion of said web of cards.

19. An apparatus as defined in claim 17 wherein said force applicator comprises at least one roller that makes contact with said portion of said web of cards.

20. An apparatus as defined in claim 14 wherein said controller comprises a motion controller and a main controller coupled to said motion controller.

21. An apparatus for automatically affixing cards having printed subject matter thereon and having no registration holes formed therein to a printed web moving at a first speed, said printed web having a plurality of repeat lengths, each of said cards being automatically applied to a successive one of said repeat lengths of said printed web at the same relative location in each of said repeat lengths, said apparatus comprising:

a pinless card feed device adapted to receive a web of cards having printed subject matter thereon and having no registration holes formed therein, said web of cards having a plurality of weakened links formed therein, each of said weakened links being disposed between a pair of adjacent cards, said pinless card feed device being adapted to cause said web of cards to pass through said pinless card feed device so that said web of cards does not slip, relative to said pinless feed device, more than 0.001 of an inch per card of said web of cards;

a card handler operatively coupled to separate said web of cards into individual cards and cause said individual cards to be applied to said printed web; and a controller operatively coupled to said pinless card feed device, said controller being adapted to control said pinless card feed device and said card handler so as to cause said web of cards to move at a second speed slower than said first speed and to cause each of said cards to be applied to said printed web in a predetermined position in each of said repeat lengths of said printed web, said controller being adapted to maintain synchronism between said second speed of said web of cards and said first speed of said printed web, and said controller being adapted to maintain a predetermined phase relationship between said web of cards and said printed web.

22. An apparatus as defined in claim 21 wherein said pinless card feed device is adapted to have a card slippage rate of less than 0.0005 of an inch per card of said web of cards.

23. An apparatus as defined in claim 21 wherein said card handler comprises a vacuum drum having an interior portion in which a suction pressure is provided and a cylindrical outer portion in which a plurality of holes are formed.

24. An apparatus as defined in claim 21 wherein said pinless card feed device comprises a force applicator adapted to force a portion of said web of cards against a portion of said pinless card feed device.

25. An apparatus for automatically affixing cards having printed subject matter thereon and having no registration holes formed therein to a printed web moving at a first speed, said printed web having a plurality of repeat lengths, each of said cards being automatically applied to a successive one of said repeat lengths of said printed web at the same relative location in each of said repeat lengths, said apparatus comprising:

a card feed device adapted to receive a web of cards having printed subject matter thereon and having no registration holes formed therein, said web of cards having a plurality of weakened links formed therein, each of said weakened links being disposed between a pair of adjacent cards, said card feed device being adapted to cause said web of cards to pass through said card feed device so that there is substantially no slippage between said card feed device and said web of cards;

a card handler operatively coupled to separate said web of cards into individual cards and cause said individual cards to be applied to said printed web; and a controller operatively coupled to said card feed device and said card handler, said controller being adapted to control said card feed device and said card handler so as to cause said web of cards to move at a second speed slower than said first speed and to cause each of said cards to be applied to said printed web in a predetermined position in each of said repeat lengths of said printed web, said controller comprising:

control means for maintaining synchronism between said second speed of said web of cards and said first speed of said printed web; and control means for maintaining a predetermined phase relationship between said web of cards and said printed web.

26. An apparatus as defined in claim 25 wherein said card handler comprises a vacuum drum having an interior portion in which a suction pressure is provided and a cylindrical outer portion in which a plurality of holes are formed.

27. An apparatus as defined in claim 25 wherein said card feed device comprises a force applicator adapted to force a portion of said web of cards against a portion of said card feed device.

28. An apparatus for automatically affixing printed items having printed subject matter thereon to a printed web moving at a first speed, said printed web having a plurality of repeat lengths, each of said printed items being automatically applied to a successive one of said repeat lengths of said printed web at the same relative location in each of said repeat lengths, said apparatus comprising:

a feed device adapted to receive an elongate web, said feed device being adapted to cause said elongate web to pass through said feed device so that there is substantially no slippage between said feed device and said elongate web, said feed device being adapted to cause said elongate web to pass through said feed device without the use of registration pins;

a handler operatively coupled to said feed device, said handler being adapted to cause said printed items to be applied to said printed web; and a controller operatively coupled to said feed device, said controller being adapted to control said feed device so as to cause said elongate web to move at a second speed slower than said first speed and to cause each of said printed items to be applied to said printed web in a predetermined position in each of said repeat lengths of said printed web, said controller being adapted to maintain synchronism between said second speed of said elongate web and said first speed of said printed web, and said controller being adapted to maintain a predetermined phase relationship between said elongate web and said printed web.

29. An apparatus as defined in claim 28 wherein said feed device comprises a cylindrical feed wheel.

30. An apparatus as defined in claim 28 wherein said feed device comprises a pinless feed device.

31. An apparatus as defined in claim 28 wherein said handler comprises a vacuum drum having an interior portion in which a suction pressure is provided and a cylindrical outer portion in which a plurality of holes are formed.

32. An apparatus as defined in claim 28 wherein said feed device comprises a feed device adapted to receive an elongate web of cards, each of said cards being separated from another of said cards by a perforation.

* * * * *